United States Patent [19]

Ferron

[11] 4,445,658

[45] May 1, 1984

[54] SUPPORT FOR GARBAGE BAGS

[76] Inventor: René Ferron, 60-De Bresoles St., Apt. No. 409, Montreal, Canada

[21] Appl. No.: 393,155

[22] Filed: Jun. 28, 1982

[51] Int. Cl.[3] ..... B65B 67/04

[52] U.S. Cl. ..... 248/99; 248/100

[58] Field of Search ..... 248/99, 95, 97, 98, 248/100, 101

[56] References Cited

U.S. PATENT DOCUMENTS

| | | | |
|---|---|---|---|
| 1,005,956 | 10/1911 | Gibbins | 248/97 |
| 3,186,667 | 6/1965 | Meuer | 248/99 X |
| 3,796,402 | 3/1974 | Trotta | 248/101 X |
| 3,861,125 | 1/1975 | Hagemeister | 248/99 X |

FOREIGN PATENT DOCUMENTS

| | | | |
|---|---|---|---|
| 25714 | 8/1914 | Canada . | |
| 774985 | 1/1968 | Canada . | |
| 1010007 | 5/1977 | Canada . | |
| 1111401 | 10/1981 | Canada . | |
| 1431508 | 1/1966 | France | 248/97 |
| 598057 | 4/1978 | Switzerland | 248/100 |

*Primary Examiner*—Ramon S. Britts
*Assistant Examiner*—Sarah A. Lechok

[57] ABSTRACT

A support frame for bags of the type having handles is disclosed. This frame enables the use of shopping bags as garbage bags. The frame includes a bag rim support ring-like member, a downwardly-spaced reinforcing member; a first pair of laterally-located bag handle catch members, each having a free lower end; a second pair of catch members located at the front and back portions of the frame for bags having handles formed in their wider sides; a close-fitting cover pivotally secured to the back portion of the frame and adapted to cover the bag rim support means and the bag rim folded thereover. The frame is adapted to be supported horizontally and may include a bag storage means at its lower end.

6 Claims, 6 Drawing Figures

SUPPORT FOR GARBAGE BAGS

FIELD OF THE INVENTION

The present invention relates to frames for supporting bags, more specifically to an improved frame for supporting plastic garbage bags having a novel attachment means for such bags.

BACKGROUND OF THE INVENTION

Plastic bags of amorphous non-rigid character have become increasingly popular as a means of dispensing garbage. Known bag holders to properly support such bags until they are full require a base onto which the bottom of the bag rests, and, at the same time, a cover to prevent undesirable odours from escaping into the air, particularly indoors. Consequently, such bag holders only accept a plastic bag of a predetermined size and cannot accept shopping bags for use as a garbage bags, since such shopping bags come in various sizes and are usually too shallow in their imperforate zones below their carrying handle. On the other hand, consumers would welcome having a holder enabling them to find a use for their surplus shopping bags, namely as garbage bags.

OBJECTS OF THE INVENTION

In view of the above, it is a first object of this invention to provide a support for plastic shopping bags of the type having carrying handles, which enables using such shopping bags as garbage bags.

It is another important object of this invention to provide a support for plastic bags which is adapted to support bags having such handles at their narrow sides as well as bags having handles formed at their wider sides.

It is yet another object of this invention to provide a support for plastic bags which incorporates bag storage means.

It is still another object of this invention to provide a support for plastic bags which is simple in design and inexpensive to manufacture.

SUMMARY OF THE INVENTION

The above and other objects and advantages of the present invention are realized by the provision of a support which comprises a horizontal ring-like member serving as bag rim support means; a close-fitting pivotally secured adjacent the back portion of the ring-like member and adapted to close over the latter; means secured to the back of said bag ring-like member to support the same in horizontal position; and at least one pair of bag handle catch members, one on each lateral side of the ring-like member and downwardly depending from the latter, the lower portion of each catch member having a free lower end. A second pair of catch members can be provided, one at the front and one at the back of the frame, each also having a free lower end. A bag, with lateral handles, may be fitted to the first pair of handle catch members, such that each handle is looped around the associated catch member and is held between the latter and the ring-like member. Similarly, a bag having handles on its wider sides can be secured to the second pair of catch members.

BRIEF DESCRIPTION OF THE DRAWINGS

The above will be more clearly understood by referring to the accompanying drawings, illustrative of the preferred embodiment, in which:

FIG. 5 is a top plan view of the frame showing on the left side a portion of the bag of FIG. 2 installed thereon.

Like numerals refer to like elements throughout the drawings.

DETAILED DESCRIPTION OF THE PREFERRED EMBODIMENT

Figure 1:
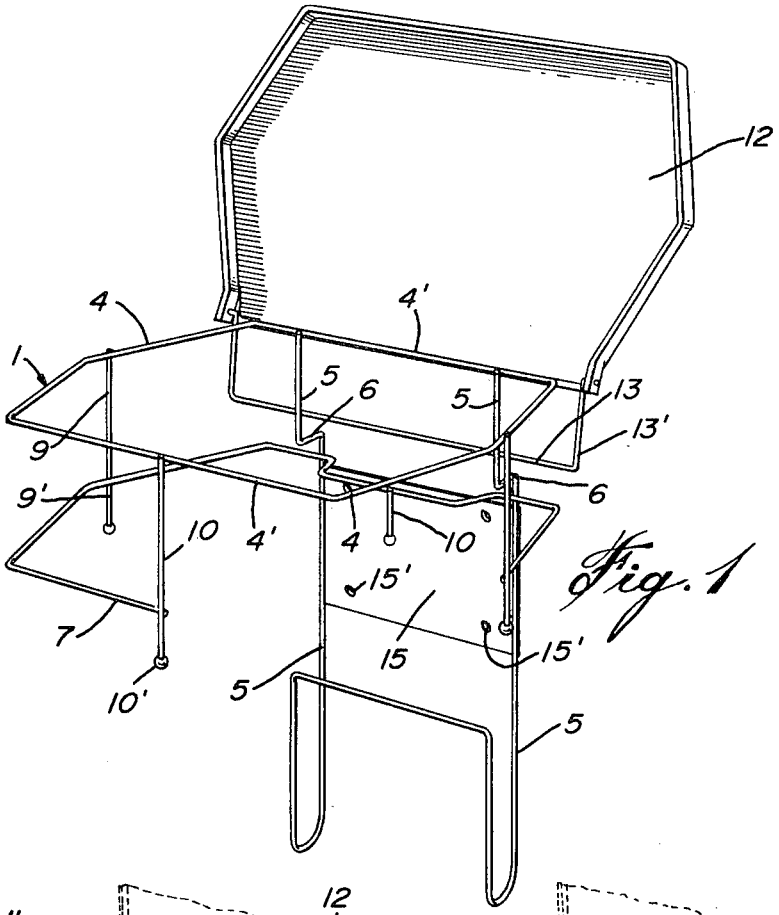
FIG. 1 is a perspective view of the frame with the cover open.

The present invention comprises a frame 1 adapted to support a plastic bag 2 of the type having a pair of integrally-formed handles 3 in open-mouth configuration on the frame. Frame 1 is preferably made of rigid wire which may be plated with chrome or covered with a suitable plastic to resist corrosion. Frame 1 could also be made entirely of a rigid plastic material.

Frame 1 is formed with a bag rim support means defined by a continuous horizontal and generally hexagonal wire element or ring-like member 4 wherein the latter has six corners and longer front and back sides 4'.

The back side 4' of member 4 is supported by and rigidly secured to a pair of spaced-apart and vertical members 5. Each member 5 is formed with a rearwardly-extending elbow 6 below their upper ends.

Figure 6:
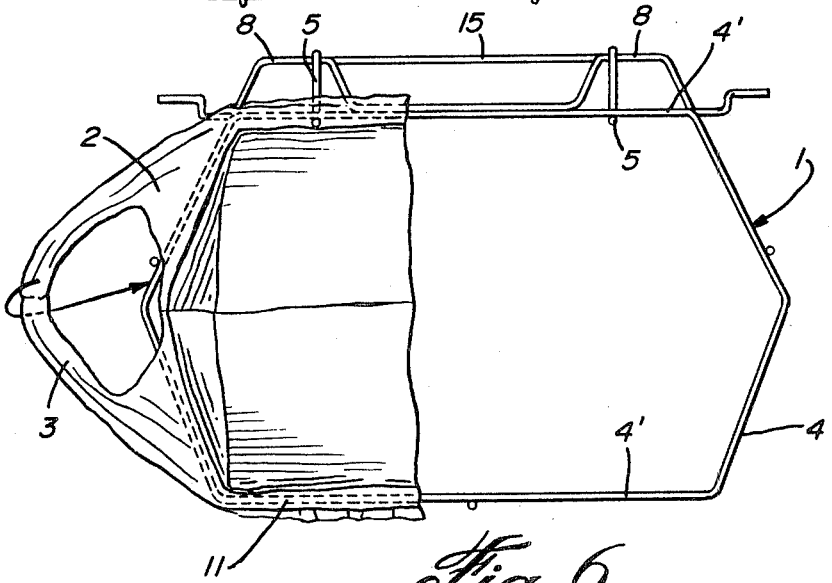

A reinforcing and horizontal perimetrical member 7, having the same general shape as element 4, is also provided being downwardly spaced from the latter and slightly below elbows 6 of vertical members 5. The two rearrcorners of member 7 are each formed into a rearwardly-extending and trapezoidally-shaped loop 8, as best seen in FIG. 6. Both loops 8 are rigidly secured to the adjacent vertical member 5.

Perimetrical member 7 and element 4 are linked together by a pair of vertically-depending bag handle catch members 9, one of the latter being secured at each side of member 7 and element 4. Each catch member 9 has a free lower end 9' which extends below perimetrical member 7.

A second pair of handle catch members 10 are provided at the mid-length of the front and back portion of perimetrical member 7, also each having a free lower end 10' projecting below member 7.

Figure 5:
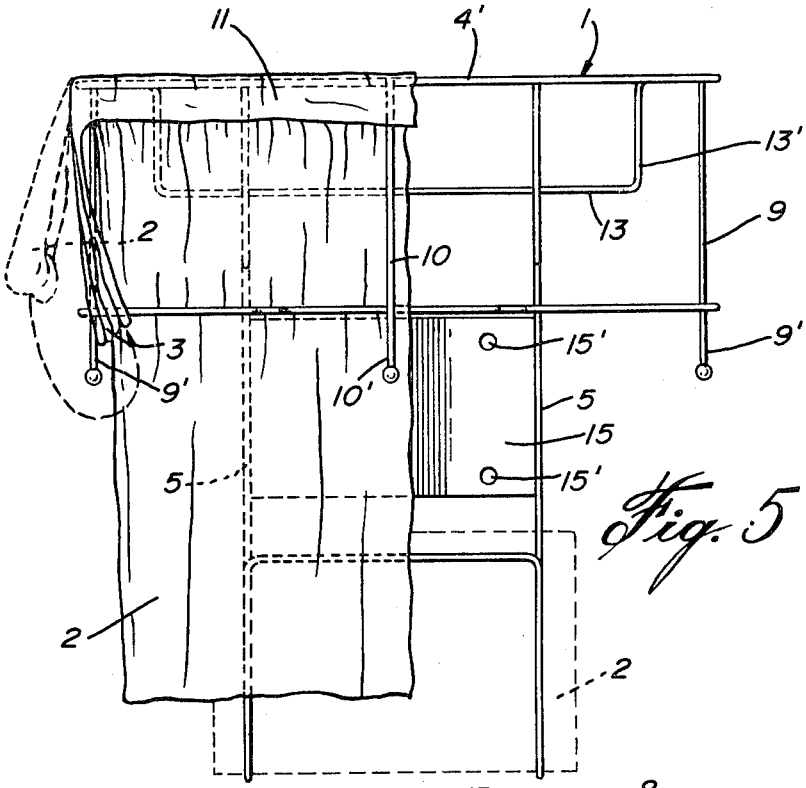
FIG. 5 is a front elevational view of the frame and a portion of the bag shown in FIG. 2, installed thereon.

To install a bag 2 on frame 1, it will be easily understood that the former is simply put into the opening defined by element 4 such that the rim portion 11 of bag 2 is folded over element 4. The handles 3 of the bag are each hooked around a catch member 9, such that they are caught between the latter and member 7 at the intersection thereof, as in FIG. 5. In this way, a bag 2 is firmly supported in mouth-open configuration until it is full and ready to be disposed of, it being noted that the handle apertures are maintained completely on the outside of ring-like member 4.

Figure 3:
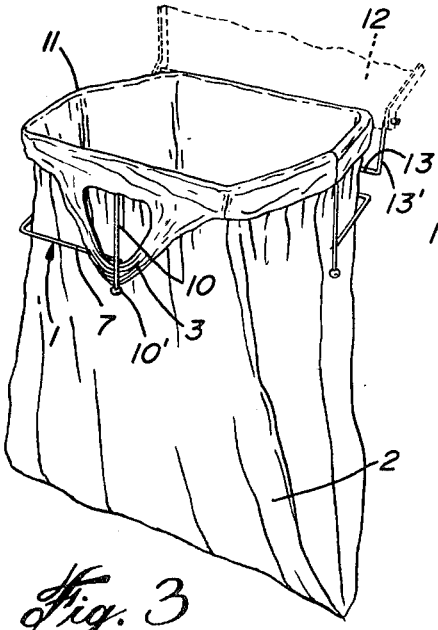
FIG. 3 is a perspective view similar to FIG. 2 but with a bag having handles formed in their wider sides.
Figure 2:
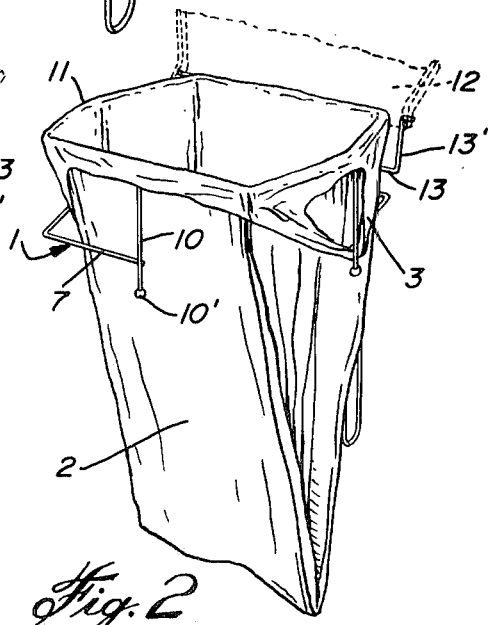
FIG. 2 is another perspective view of the frame and a bag installed thereon, the bag being of the type having handles formed in their narrower sides.
Figure 4:
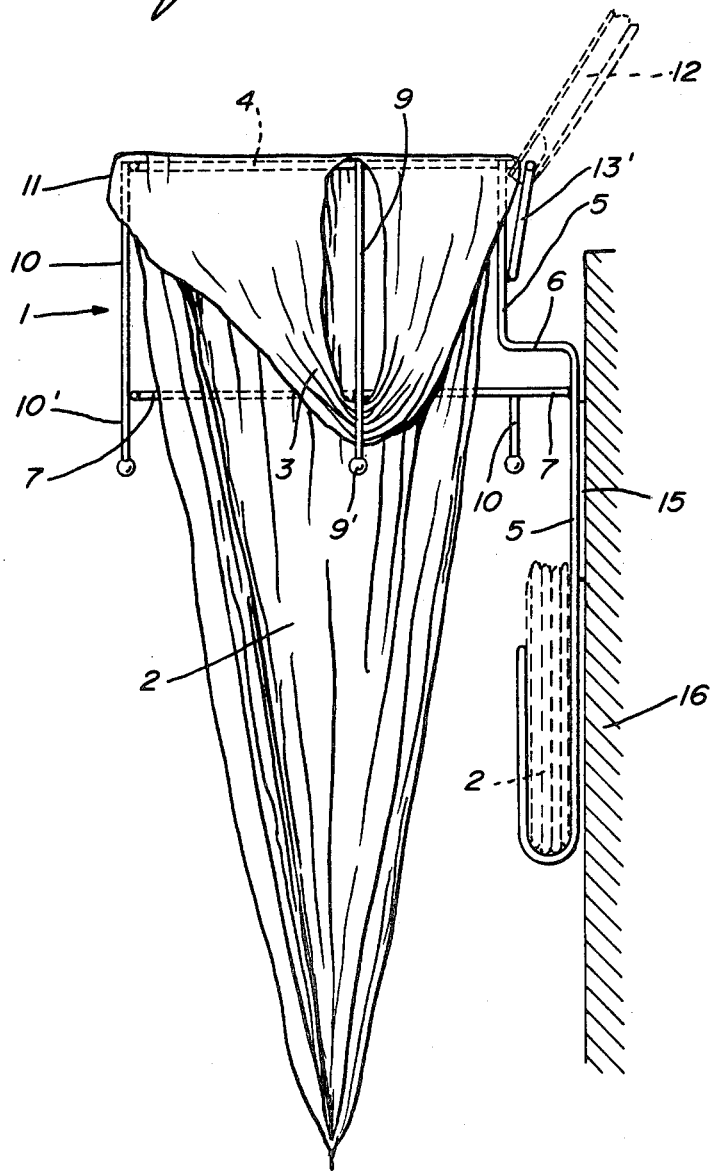
FIG. 4 is a side elevation of the frame and a bag, as shown in FIG. 2, also showing a portion of a wall to which the frame is attached.

It will also be readily understood that the invention also provides a support for those bags, having handles which are formed in the wider sides of the bag, as shown in FIG. 3. Such bags are installed in frame 1 in the same manner as described above but having their handles secured around front and back catch members 10.

In order to prevent unpleasant odours from circulating in the air, a cover 12 is provided for frame 1, having the same general shape as element 4 over which it closely fits. Cover 12 is pivotally secured adjacent the rear of element 4 to a bow element 13, having upstanding lateral ends 13' which are co-planar with element 4 and spaced slightly rearwardly thereof to allow the rim 11 of a bag to fold over element 4. Bow 13 is secured to vertical member 5 slightly above elbows 6.

Preferably, a flat plate 15 is secured between element 5 below member 7, having holes 15' at its four corners, whereby the frame 1 may be secured or nailed to a vertical wall 16, such as that provided by the inner surface of a cupboard door.

Preferably, also, the lower ends of members 5 are bent upwardly and linked together to define a bag storage means adapted to hold a plurality of bags 2.

It is to be noted that the vertical attachment means of the frame could easily be modified to a floor support means for the frame without departing from the scope or spirit of the invention. For example, members 5 could be extended to form a horizontal base.

Wire element 4 forms a ring-like member having a smooth planar top surface, so that the cover 12 can have substantially tight engagement with the bag folded over element 4. When the support is made of plastic, at least elements 4, 7, and 9, and also 10 if the latter are present, can be made of a one-piece construction.

What I claim is:

1. A bag support, specifically adapted for bags of the type having integral handles which determine corresponding apertures within the walls of said bags; said bag support comprising an open frame and a close-fitting cover; said frame including:

(A) a ring-like member, serving as bag support means, and determining an open mouth;

(B) a rear support means, secured to the back portion of said ring-like member, for supporting the latter in substantially horizontal position; and (C) at least one pair of downwardly-depending bag handle catch members, secured to said ring-like member, each having a free lower end and a transverse stop member secured to said catch member at a zone spaced above said free lower end; said catch members being located at each lateral side of the frame; said cover being pivotally secured to the frame adjacent the back portion of said ring-like member, and being adapted to closely fit over the latter; whereby the rim portion of a bag inserted within said ring-like member is adapted to be folded over said ring-like member with said handles of said bag extending downwardly on the outside of said ring members hooked around the respective free ends of the catch members and retained by said stop members, said stop members being located a distance below said ring member sufficient to retain said bag in a position such that said bag apertures will extend downwardly on the outside of said ring member and said ring-like member will be completely covered by the walls of said bag, whereby the closing of said cover over said open mouth will seal off the content of said bag.

2. A bag support as defined in claim 1 wherein said stop members are formed by a single perimetrical member secured to said catch members and substantially parallel to said ring-like member.

3. A bag support as defined in claim 2, wherein said ring-like and perimetrical members are generally hexagonal in shape, having six corners and also having longer front and back portions.

4. A bag support as defined in claim 1, wherein a second pair of bag handle catch members are formed at the said front and back portions of said ring-like member; said second pair also extending below said ring-like member and having a free lower end, whereby a bag having handles on its wider sides, can be installed on the frame.

5. A bag support as defined in claim 1, wherein said support means includes a pair of laterally-spaced parallel vertical members provided with means to attach the same to a vertical surface.

6. A bag support as defined in claim 5, wherein the lower ends of said vertical members define a bag storage means.

* * * * *